US008534083B2

(12) United States Patent
Austin et al.

(10) Patent No.: US 8,534,083 B2
(45) Date of Patent: Sep. 17, 2013

(54) EVAPORATIVE COOLING CONDENSER FOR HOUSEHOLD APPLIANCE

(75) Inventors: Martin Nicholas Austin, Louisville, KY (US); Joel Erik Hitzelberger, Louisville, KY (US); Jeffrey M. Wood, Louisville, KY (US); Richard DeVos, Goshen, KY (US); Andrew Jason Veenstra, Louisville, KY (US); Brent Alden Junge, Evansville, IN (US)

(73) Assignee: General Electric Company, Schenectady, NY (US)

( * ) Notice: Subject to any disclaimer, the term of this patent is extended or adjusted under 35 U.S.C. 154(b) by 142 days.

(21) Appl. No.: 12/855,361

(22) Filed: Aug. 12, 2010

(65) Prior Publication Data

US 2012/0036877 A1 Feb. 16, 2012

(51) Int. Cl.

| | |
|---|---|
| ***F25D 21/00*** | (2006.01) |
| ***F25D 5/00*** | (2006.01) |
| ***F25B 39/04*** | (2006.01) |

(52) U.S. Cl.

USPC ..... 62/150; 62/171; 62/183; 62/305

(58) Field of Classification Search

USPC ..... 62/121, 150, 171, 183, 259.4, 304, 62/305, 310, 316; 261/27

See application file for complete search history.

(56) References Cited

U.S. PATENT DOCUMENTS

| | | | | |
|---|---|---|---|---|
| 3,284,068 | A * | 11/1966 | Goettl | 261/97 |
| 3,872,684 | A * | 3/1975 | Scott | 62/181 |
| 5,113,668 | A | 5/1992 | Wachs, III et al. | |
| 5,117,644 | A * | 6/1992 | Fought | 62/171 |
| 5,154,066 | A | 10/1992 | Choi | |
| 5,285,651 | A * | 2/1994 | Marine | 62/171 |
| 5,411,078 | A | 5/1995 | Ares | |
| 5,590,541 | A | 1/1997 | Rainwater | |
| 5,605,052 | A * | 2/1997 | Middleton et al. | 62/171 |
| 5,701,748 | A * | 12/1997 | Phelps et al. | 62/91 |
| 5,775,580 | A | 7/1998 | Sizemore et al. | |
| 6,141,986 | A * | 11/2000 | Koplin | 62/304 |
| 6,223,545 | B1 * | 5/2001 | Kinkel et al. | 62/171 |
| 6,338,256 | B1 * | 1/2002 | Tien | 62/305 |
| 6,871,507 | B1 * | 3/2005 | Goldsmith | 62/183 |
| 6,964,175 | B2 | 11/2005 | Karkhanis | |
| 7,278,274 | B2 | 10/2007 | Kim | |
| 7,757,499 | B2 * | 7/2010 | Jensen | 62/121 |
| 2008/0173032 | A1 | 7/2008 | Kammerzell et al. | |
| 2008/0250799 | A1 | 10/2008 | Konopa et al. | |
| 2012/0047936 | A1 * | 3/2012 | Junge | 62/291 |

FOREIGN PATENT DOCUMENTS

| | | | |
|---|---|---|---|
| JP | 1997-269181 | A | 10/1997 |
| WO | 2005/106360 | A | 11/2005 |

* cited by examiner

*Primary Examiner* — Marc Norman

(74) *Attorney, Agent, or Firm* — Global Patent Operation; Douglas D. Zhang

(57) ABSTRACT

An evaporative cooling condenser for a household appliance cooling system includes a water source, a heat exchanger configured to contain a refrigerant, and a fluid heat transfer device, the fluid heat transfer device configured to receive water from the water source and apply the water to the heat exchanger for rejecting heat from the heat exchanger.

18 Claims, 7 Drawing Sheets

EVAPORATIVE COOLING CONDENSER FOR HOUSEHOLD APPLIANCE

BACKGROUND

The present disclosure generally relates to appliances, and more particularly to an evaporative cooling condenser for a household appliance.

Government regulations and consumer demand strongly encourage the development of low energy use appliances. Cooling and air-conditioning systems for appliances such as refrigerators use a great deal of energy. Efforts to produce highly efficient appliances can be costly. For example, various approaches to energy-saving appliances have been developed that include the use of vacuum panels to decrease the heat entering the refrigerator. However, the use of vacuum panels requires the addition of expensive parts, thus increasing the total cost of the appliance for a consumer. Evaporative cooling is used in larger commercial refrigeration applications and systems to reduce the heat of the liquid refrigerant flowing from the condenser into the evaporator, thereby increasing heat absorption and decreasing the amount of energy use required. However, a practical method to apply an evaporative cooling process to a household appliance, such as a refrigerator, has not been developed.

Accordingly, it would be desirable to provide a system that addresses at least some of the problems identified.

BRIEF DESCRIPTION OF THE EMBODIMENTS

As described herein, the exemplary embodiments overcome one or more of the above or other disadvantages known in the art.

One aspect of the exemplary embodiments relates to an evaporator cooling condenser for a household appliance. In one embodiment, the evaporator cooling condenser includes a water source, a condenser coil, and a fluid heat transfer device. The fluid heat transfer device is configured to receive water from the water source and apply the water to the condenser coil to enable the condenser coil to reject heat.

In another aspect, the disclosed embodiments are directed to a cooling system for a household appliance. In one embodiment, the household appliance includes an evaporator stage, a compressor stage coupled to the evaporator stage, and a condenser stage coupled between the compressor stage and the evaporator stage. The condenser stage includes an evaporative cooling condenser.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS

Figure 1:
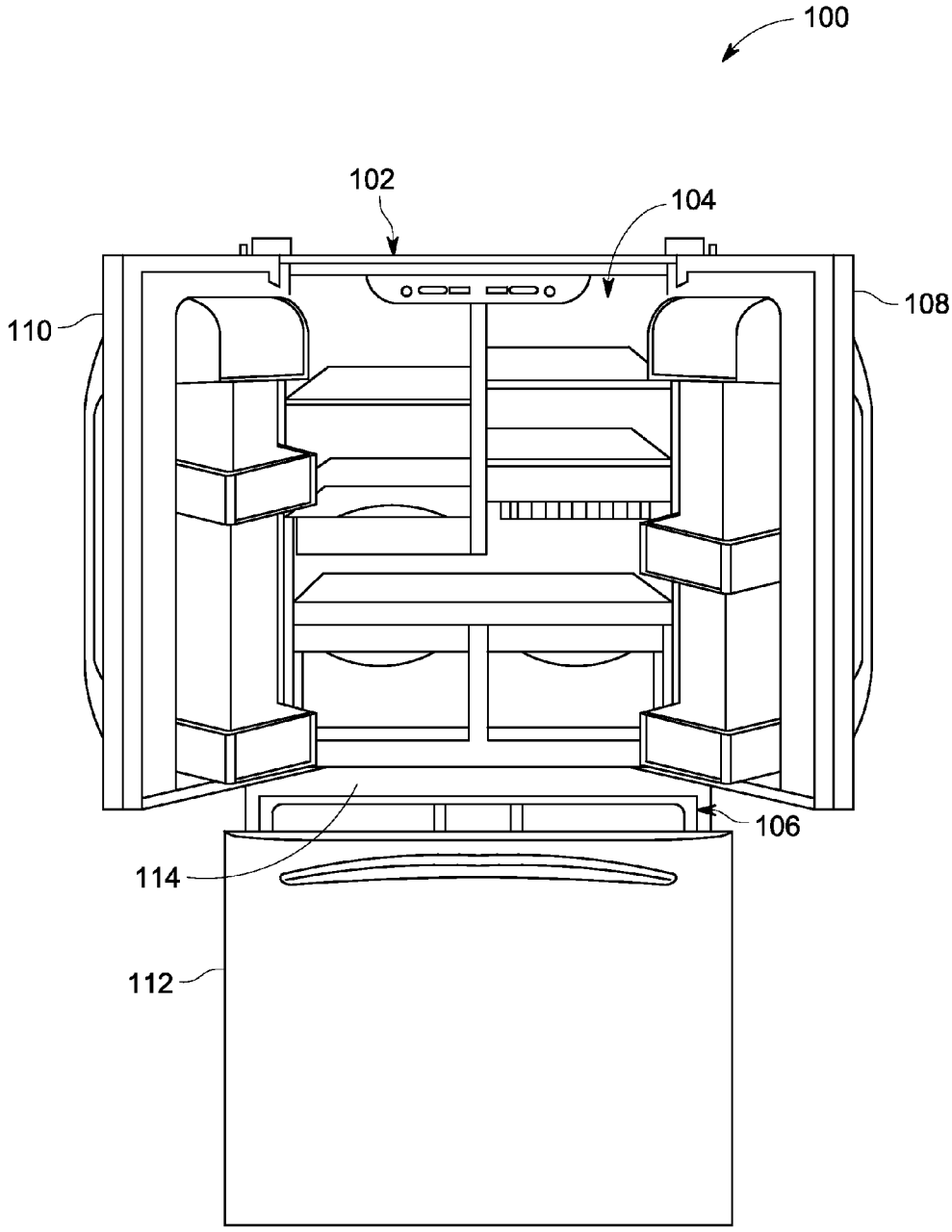
FIG. 1 is a perspective view of an exemplary appliance incorporating aspects of the disclosed embodiments.

Referring to FIG. 1, an exemplary household appliance, such as a refrigerator, incorporating aspects of the disclosed embodiments, is generally designated by reference numeral 100. The aspects of the disclosed embodiments are generally directed to lowering the condenser temperature of a refrigerant based cooling system in a household appliance to allow the refrigerant to absorb more heat in the evaporator. An evaporative cooling condenser is used to lower the condenser temperature so that the refrigerant exiting the condenser and entering the capillary tube will be at a lower enthalpy. The lower enthalpy allows the refrigerant to absorb more heat when it reaches the evaporator, which increases the cooling capacity of the household appliance without increasing the energy usage or costs. The compressor discharge pressure will also be lowered, reducing the energy consumed by the compressor. Although the aspects of the disclosed embodiments will generally be described with a respect to a household appliance such as a refrigerator, in alternate embodiments the household appliance can comprise any suitable household appliance that includes a refrigerant based cooling system, such as for example, a freezer or air conditioning unit.

An exemplary refrigerator 100 is shown in FIG. 1. The refrigerator 100 shown in FIG. 1 is a multi-compartment refrigerator 100 that includes at least two compartments within a cabinet structure 102, including, for example, a fresh food compartment 104 and a freezer compartment 106. In alternate embodiments, the refrigerator 100 of the present disclosure can include any suitable number of compartments. The refrigerator 100 includes doors 108 and 110 for the fresh food compartment 104, and door 112 for the freezer compartment 106. A divider or mullion 114 separates the fresh food compartment 104 from the freezer compartment 106.

Figure 2:
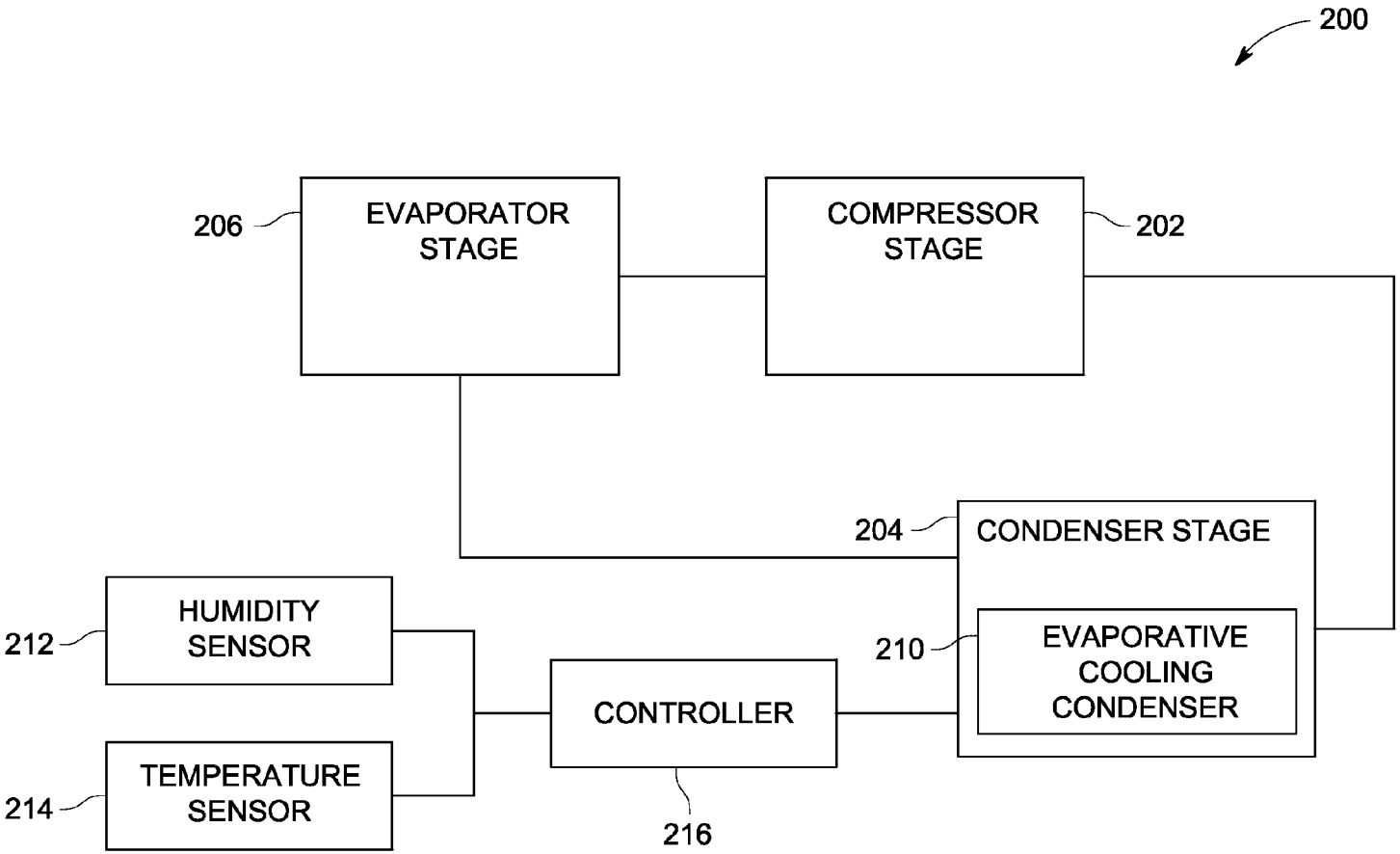
FIG. 2 is a block diagram of one embodiment of a cooling system incorporating aspects of the present disclosure.

FIG. 2 illustrates one embodiment of a cooling system 200 for a refrigerator 100 incorporating aspects of the disclosed embodiments. In one embodiment, the cooling system 200 includes a compressor stage 202, a condenser stage 204, and an evaporator stage 206. In one embodiment the condenser stage 204 includes an evaporative cooling condenser 210.

The compressor stage 202 is generally configured to compress a low, ambient temperature and low-pressure refrigerant received from the evaporator stage 206 into a high-temperature and high-pressure gaseous refrigerant. The condenser stage 204 is connected to the compressor stage 202 and is configured to condense the compressed gaseous refrigerant into a liquid refrigerant. The evaporator stage 206 is connected between the condenser stage 204 and the compressor stage 202 and is generally configured to evaporate the expanded refrigerant, absorb heat and generate cool air. Each of the compressor stage 202, the condenser stage 204 and evaporator stage 206 can include other suitable components for providing the general functionalities described herein.

The evaporative cooling condenser 210 of the disclosed embodiments is generally configured to lower the condenser stage temperature by cooling the air entering the condenser stage 204 from the ambient thy bulb temperature to a point that is closer to the wet bulb temperature, or by causing the condenser stage 204 to reject heat to a pool of water. In one embodiment, referring to FIG. 3, a fluid, such as water or water vapor, is introduced into a fluid heat transfer device 312, where the fluid is passed over, or brought in contact with, a condensing coil 302. The condensing coil 302 generally comprises a heat exchanger containing refrigerant, and is located after the compressor stage 202 and before the evaporator stage 206. In one embodiment, the fluid can be introduced by the fluid heat transfer device 312 into an airflow path 310 passing through the condenser coil 302, or the condenser coil 302 can be continually wetted by the fluid. A heat convection process will cause the condenser coil 302 to reject heat to the fluid, thus lowering the temperature of the condenser stage 204.

For example, when water or water vapor is introduced into the airflow path 310 and the air is pulled through the condensing coil 302, such as by a fan 308, the water will evaporate. The evaporation removes heat from the refrigerant vapor in the condenser coil 302, thus reducing the temperature of the condensed refrigerant. When the condenser coil 302 is brought in contact with water, such as by wetting the coil 302 with water or immersing the condenser coil 302 into a pool of water that is lowered to an ambient temperature or below by evaporative cooling, the condensing temperature will be lowered by rejecting heat to this water. The reduced condensing temperature allow the refrigerant to absorb more heat in the evaporator stage 206, reduce compressor power, and thus lower energy use and costs. Generally, a one-degree Fahrenheit reduction in the temperature of the condenser stage can reduce refrigerator energy use by one percent or more.

In one embodiment, the system 200 can include a humidity sensor 212. The humidity sensor 212 can be part of the condenser stage 204, or can be separately included in the system 200, as a stand-alone device or part of a system controller 216. The humidity sensor 212 is generally configured to detect a humidity level in an area of the appliance and enable or disable the evaporative cooling condenser 210 depending upon the humidity level. In one embodiment, a signal corresponding to the detected humidity level is sent to a controller 216, where the controller 216 is configured to enable or disable the evaporative cooling condenser 210. The aspects of the disclosed embodiments are generally applicable in environments where the relative humidity levels are below a predetermined values, such as for example, approximately 40-50% relative humidity, and are less effective at humidity levels that are higher than approximately 70%.

As is shown in FIG. 2, in one embodiment, the cooling system 200 can also include a temperature sensor 214. The temperature sensor 214 can be configured to monitor one or more of the ambient temperature, or the temperature of the system components such as the compressor stage 202 or the condenser stage 204. The temperature sensor 214 can provide temperature indications to the controller 216, where the controller 216 can interpret the data for the purpose of determining whether or not to activate the evaporative cooling condenser 210. For example, if the ambient temperature is not high enough to provide adequate evaporation of the water, under certain humidity conditions, the controller 216 can interrupt or disable the operation of the evaporative cooling condenser 210. The humidity and temperature readings from the sensors 212, 214, can also be used by the controller 216 to increase or decrease the flow of fluid to the fluid heat transfer device 312 shown in FIG. 3. For example, in high ambient temperature conditions, it may be desirable to increase the fluid flow to the fluid heat transfer device 312, while in low ambient temperature conditions, where fluid evaporation is not favorable, the flow of fluid to the fluid heat transfer device 312 can be decreased.

Figure 3:
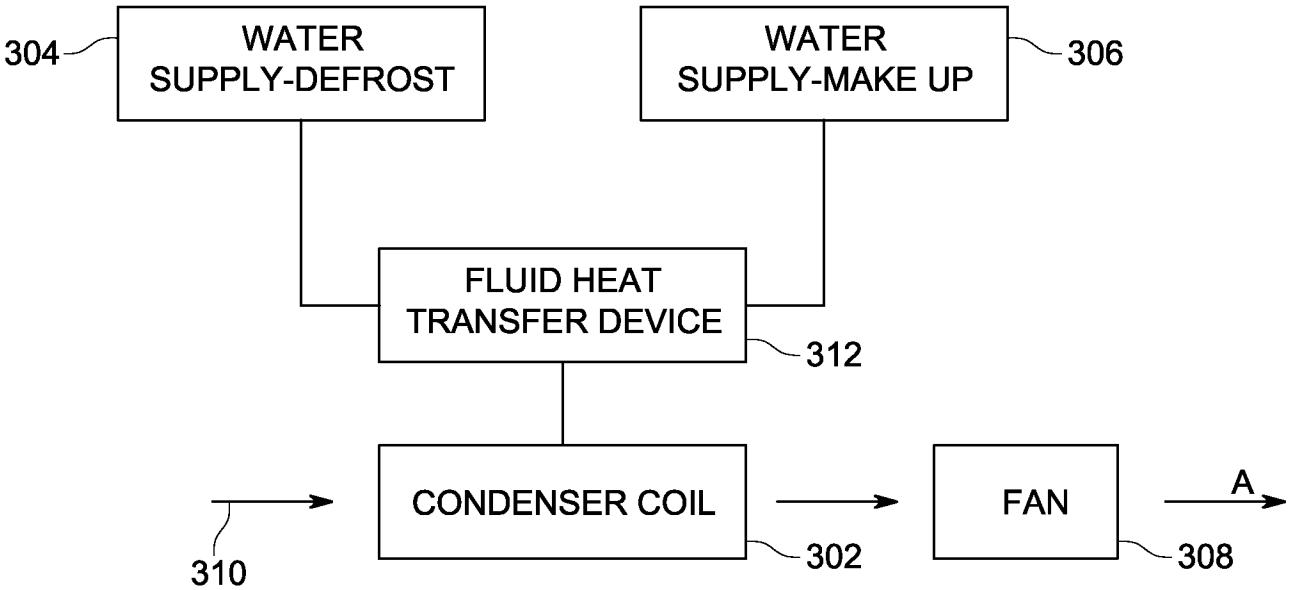
FIG. 3 is a schematic block diagram of an exemplary evaporative cooling condenser incorporating aspects of the disclosed embodiments.

As is shown in FIG. 3, the aspects of the disclosed embodiments utilize both defrost drain water and make-up water as sources of water for the fluid heat transfer device 312. In one embodiment, the defrost drain water can also include water or condensation that may form on the interior or exterior surfaces of the cabinet structure 102 and is collected. A first source is the defrost drain water 304 that is generated as a result of a defrosting cycle or process in the cooling system 200. The second source of water is the make-up water 306, which can be an external water source. Each source 304, 306 can be suitably coupled to the fluid heat transfer device 312, by for example, a valve, where each source 304, 306 can be individually controlled to provide water to the fluid heat transfer device 312. By using both defrost drain water 304 and make-up water 306, the defrost drain water 304 can be recycled, allowing water to be supplied to the evaporative cooling condenser 210 in a practical and energy efficient manner.

Figure 4:
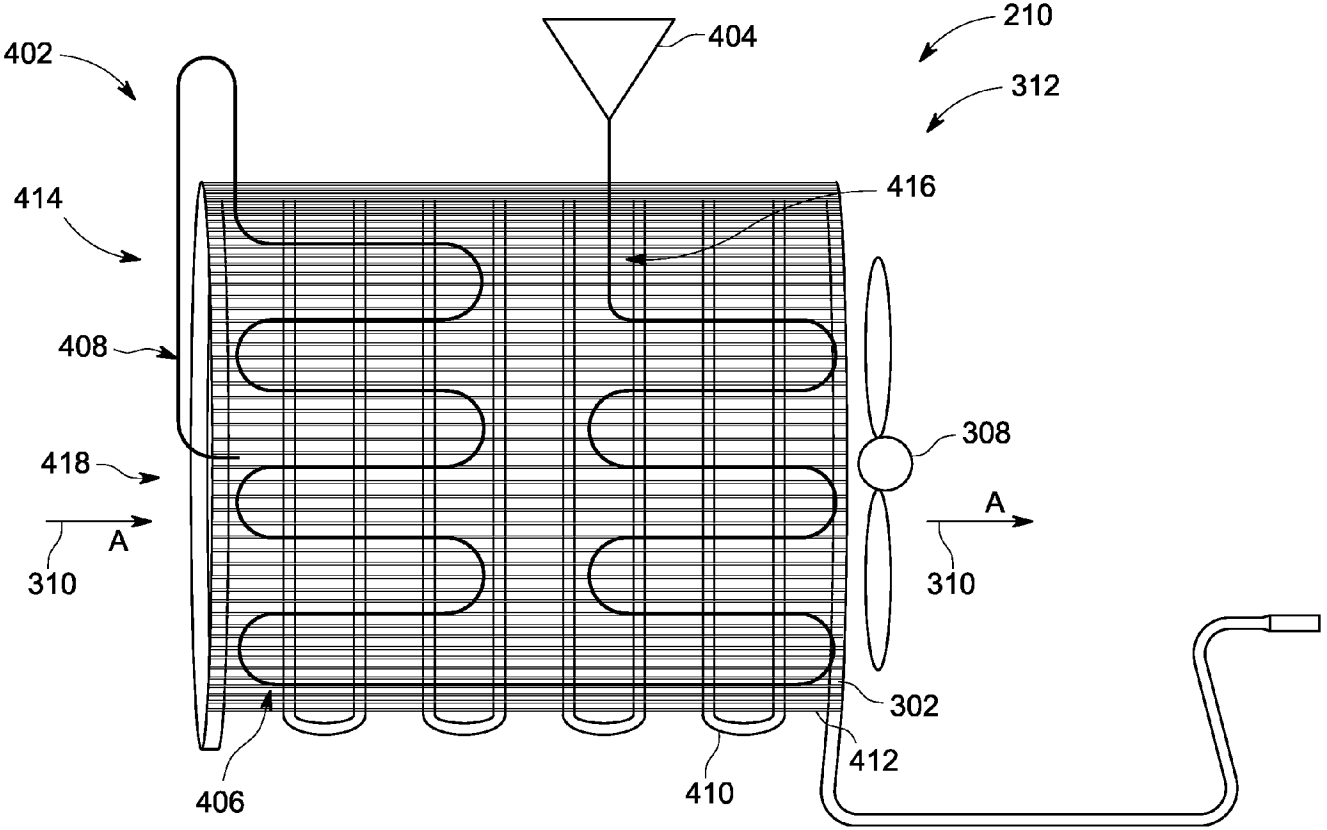
FIG. 4 illustrates an exemplary heat transfer device for an evaporative cooling condenser incorporating aspects of the disclosed embodiments.

FIG. 4 illustrates one example of an evaporative cooling condenser 210 incorporating aspects of the disclosed embodiments. In this embodiment, the evaporative cooling condenser 210 shown in FIG. 4 is generally configured to use water in the form of vapor or steam, generally referred to herein as water vapor, to remove heat from the condenser coil 302. The fluid heat transfer device 312 in this example is configured to release water vapor into an inner portion or area of the condenser coil 302 where the water vapor can mix with the air stream 310 flowing through the condenser coil 302. The evaporative cooling process will lower the condensing temperature.

In the embodiment shown in FIG. 4, the fluid heat transfer device 312 comprises a water vapor generating device 402. The water vapor generating device 402 generally comprises a water fill device 404, tubing 406 and water vapor jet 408. The condenser coil 302 generally comprises tubing 410 and heat conductive fins 412.

As shown in FIG. 4, the condenser coil 302 is generally circular in nature, in the form of a cylinder. In alternate embodiments, the condenser coil 302 can be configured in any suitable geometric shape. In the embodiment shown in FIG. 4, the airflow path 310 generally flows into and through the inner area 418 of the condenser coil 302 in the direction A from end 414. Air can also be drawn into the inner area 418 from the sides of the condenser coil 302, across the tube 410 and fins 412. In one embodiment, a fan 308 can be used to assist and direct the airflow path 310 through the condenser coil 302. In this fashion, heat is removed or transferred from the condenser coil 302 in a convection heat transfer process.

The water vapor generating device 402 receives water from water dispensing device or source 404. The water dispensing device 404 is configured to receive water from both the defrost water supply 304 and the make-up water supply 306. In one embodiment, the water dispensing device 404 comprises a reservoir for storing water. In alternate embodiments, the water dispensing device 404 can comprise a pump or valve that is cycled between an open and closed state to allow water to enter the tube 406 from the dispensing device 404. Where the water dispensing device 404 is a reservoir, a water level sensor 416 can be provided that allows the water to fill in the reservoir to a certain level. In one embodiment the water level sensor 416 can comprise a float mechanism. In alternate embodiments, any suitable water level sensor device can be used, other than including a float.

In one embodiment, the flow of water into the tubing 406 from the water dispensing device 404 can be regulated. The rate of the flow of water will be such that the water in the tube 406 can evaporate without overflowing from the tube 406. In one embodiment, the flow rate will be at a slow rate, such as for example a drip rate. The water dispensing device 404 can include a suitable valve mechanism can be used to regulate the flow of water, which in one embodiment can also be a time-release valve mechanism.

The tubing 406 is generally in thermal or physical contact with the condenser 302 and is suitably arranged on the condenser 302. In the example shown in FIG. 4, the tubing 406 is arranged in a substantially serpentine pattern along or around an outer surface of the condenser 302. In alternate embodiments, the tubing 406 can be arranged in any suitable configuration or pattern that promotes the transformation of the liquid water into vapor as it moves from the water dispensing device 404 through tube 406 to the water vapor jet 408 end. In one embodiment, the tubing 406 is a thermally conductive material such as metal. This allows the tubing 406 to remove heat from the condenser 302 and heat the water inside the tube 406. Generally, the water exiting the evaporator stage 206 into the defrost water supply 304 will be at a temperature level of approximately 32 degrees Fahrenheit. The water in the tube 406 will heat to a level approximating an evaporation point, and can be released from the water vapor jet 408 as liquid vapor or steam. In one embodiment, the water dispensing device 404 can include a valve to prevent the release of water vapor or steam from the water dispensing device 404 end of the tubing 406.

Figure 5:
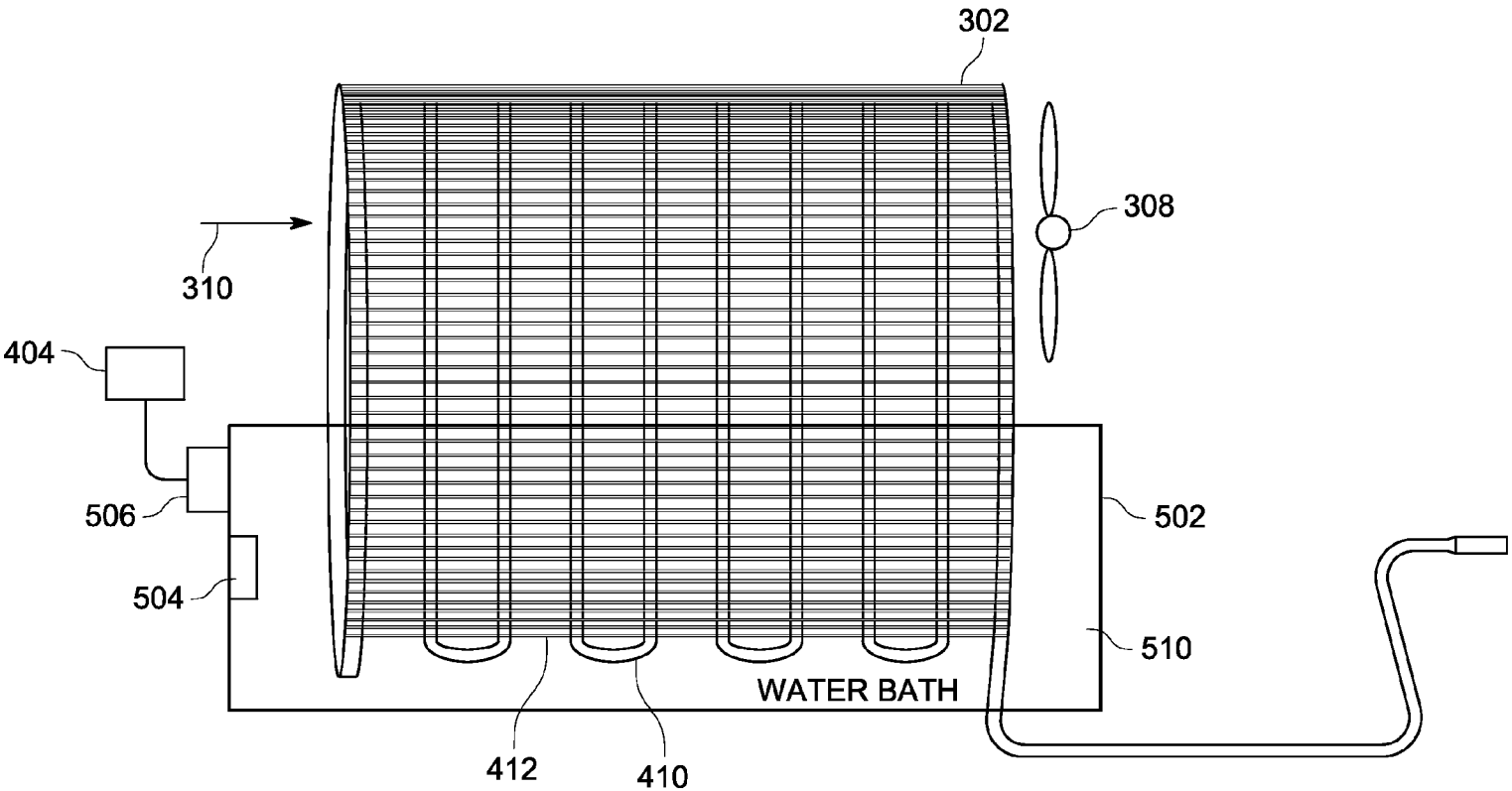
FIG. 5 illustrates an exemplary heat transfer device for an evaporative cooling condenser incorporating aspects of the disclosed embodiments.

FIG. 5 illustrates another example of an evaporative cooling condenser 210 incorporating aspects of the disclosed embodiments. In this example, water is collected in a water reservoir or vessel 502, such as a pan or tub, to form a water bath 510. In this example, the water bath 510 generally comprises the fluid heat transfer device 312. As shown in FIG. 5, the condenser coil 302 is placed near or in the vessel 502. The water for the vessel 502 is delivered by the water dispensing device 404, which as noted above supplies water from one or both of the defrost water supply 304 and the make-up water supply 306. The vessel 504 can include a water level sensor 504, such as for example a float valve, that can be used to regulate the level of water in the vessel 502. The water level sensor 504 can be coupled to a valve 506 that can be used to regulate the flow of water and fill level.

Although the embodiment in FIG. 5 shows a portion of the condenser coil 302 submerged in the water bath 510, the condenser coil 302 does not have to be submerged for the evaporative cooling condenser 210 to have effective results. In one embodiment, the vessel 502 can be placed in front of, or in the path of the air flow 310. When the condenser coil 302 is submerged in the water bath 510, the amount of submersion can be approximately one-half of the condenser coil 302. In high humidity levels, the humidity sensor 212 can be configured to prevent water from filling the vessel 502.

Figure 6:
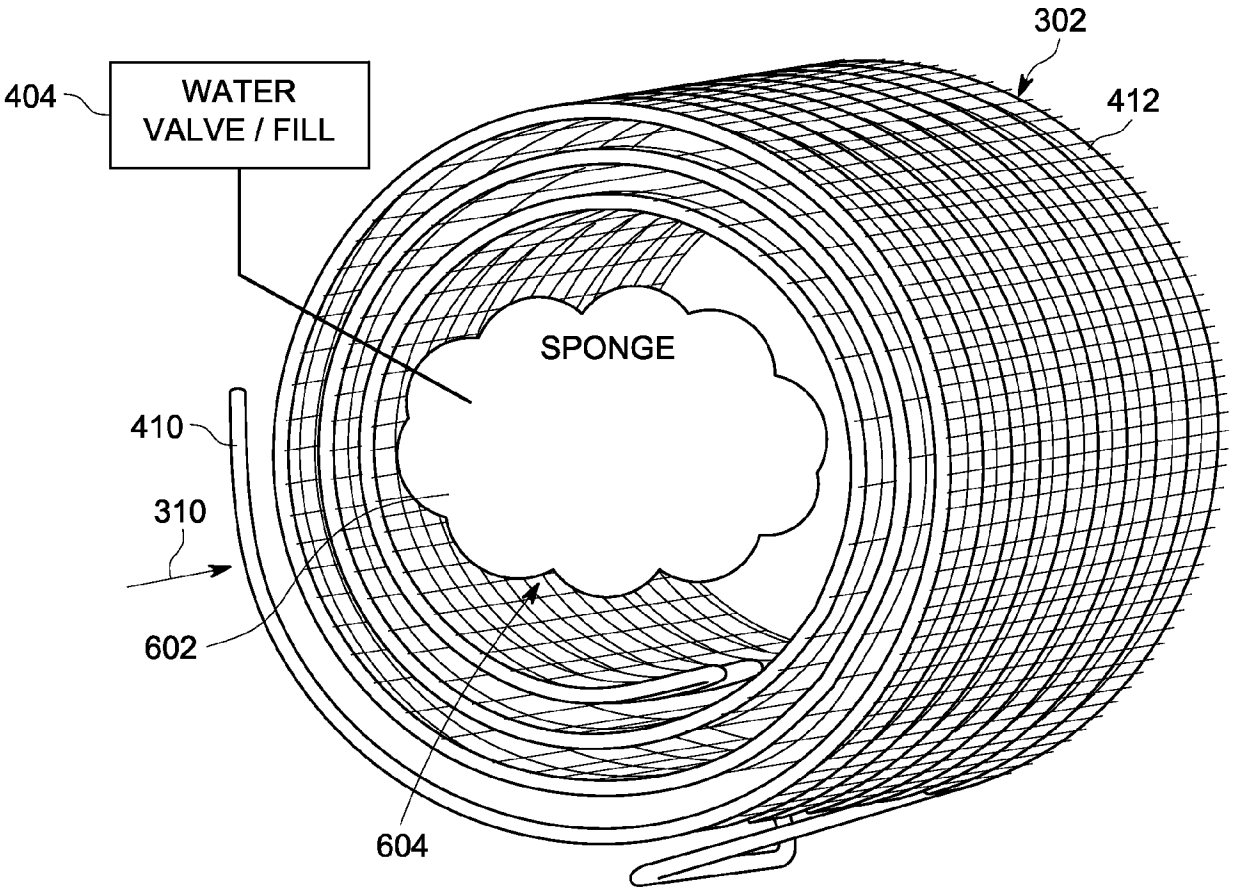
FIG. 6 illustrates an exemplary heat transfer device for an evaporative cooling condenser incorporating aspects of the disclosed embodiments.

FIG. 6 illustrates another example of an evaporative cooling condenser 210 incorporating aspects of the disclosed embodiments. In this example, the fluid heat transfer device 312 comprises an evaporative pad or other suitable device that is configured to absorb fluid such as water. In one embodiment the evaporative pad 602 is a sponge. In alternate embodiments, the evaporative pad can comprise any suitable water retaining device, other than including a sponge. The evaporative pad 602 is generally configured to absorb the water, and provide an evaporative effect as the airflow 310 passes over the evaporative pad 602.

As shown in FIG. 6, the evaporative pad 602 is retained in an interior or central section of the condenser coil 302. The evaporative pad 602 is generally configured to be dampened with, or absorb water. As the ambient air moves across the evaporative pad 602, the heat in the air evaporates the water from the pad 602. The pad 602 is continually re-dampened to continue the cooling process. The use of the pad 602 increases the evaporation rate of the water used in conjunction with the evaporative cooling condenser 210.

The water dispensing device 404 is configured to provide water to, and/or wet the evaporative cooling pad 602. In one embodiment, a timed fill water delivery method can be used, where the water dispensing device 404 is activated or opened for a pre-determined time according to a pre-determined schedule to provide a flow of water. The schedule or fill cycle could also be based on, or affected by factors such as, the ambient temperature of the area of the appliance 100, the relative humidity of the area or the defrost cycle of the cooling system 200. The delivery or fill rate of the water to the evaporative pad 602 can be based on a size or configuration of the pad 602, the number of evaporative pads 602 being used, and should be sufficient to maintain the evaporative pad 602 in a moist, dampened or saturated state. A base plate or other suitable water collection device can be placed underneath the condenser 302 to collect any water that is not evaporated from or drips or flows from the evaporative pad 602.

In one embodiment, the evaporative pad 602 is secured within the central portion 604 of the condenser coil 302 and in the airflow path 310. The evaporative pad 602 can be supported within the central portion 604 of the condenser coil 302 in any suitable manner, using for example, a supporting bracket. In one embodiment, portions of the evaporative pad 602 can be in physical or thermal contact with the condenser coil 302. As air flows into and through the central portion 604 of the condenser coil 302, the airflow 310 will flow across the evaporative pad 602. The water that is absorbed or retained in the evaporative pad 602 will cool the air and allow the air to absorb more heat from the condenser coil 302. Similarly, if any portions of the evaporative pad 602 are in physical or thermal contact with any portions of the condenser coil 302, water in the evaporative pad 602 at those portions will also absorb heat and cool the condenser coil 302 through the convection process.

In another embodiment, the evaporative pad 602 of FIG. 6 can be placed in a water containing device, such as for example, the water vessel 502 shown in FIG. 5. In this example, the evaporative pad 602 can sit in, or be partially submerged in the water in the water vessel 502. The amount to which the evaporative pad 602 is submerged should be sufficient to allow the evaporative pad 602 to remain wet or moist in those areas that are above the water line. A float and valve assembly can be used to maintain a sufficient level of water in the water vessel 502.

Figure 7:
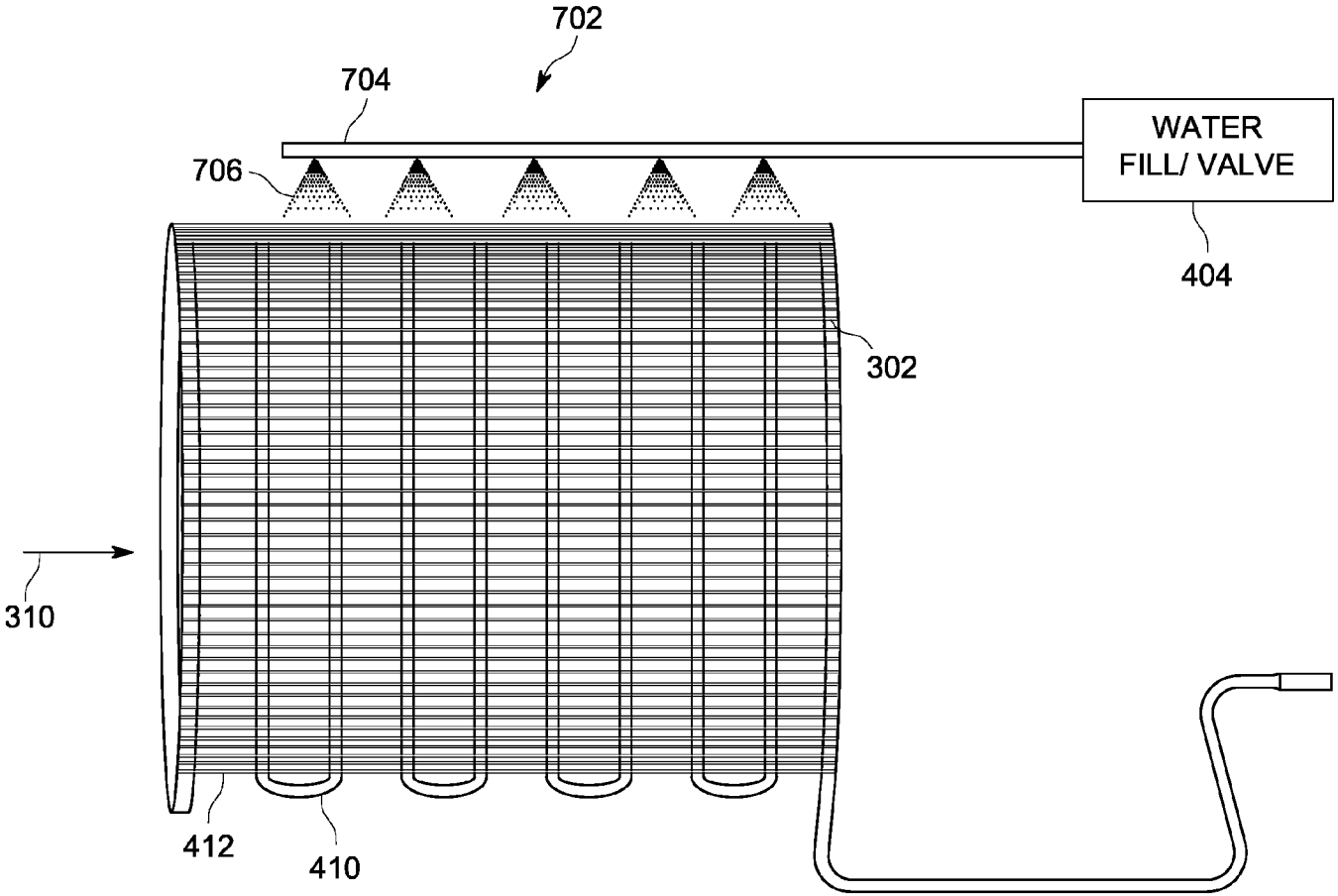
FIG. 7 illustrates an exemplary heat transfer device for an evaporative cooling condenser incorporating aspects of the disclosed embodiments.

Another example of an evaporative cooling condenser 210 incorporating aspects of the disclosed embodiments is shown in FIG. 7. In this example, the fluid heat transfer device 312 comprises a fluid misting device 702. The misting device 702 is generally configured to convert the water from the water dispensing device 404 into a spray of water in the form of a mist and direct the mist onto the condenser coil 302. The water, in the form of the mist, will evaporate when it comes in contact with the condenser coil 302. As shown in FIG. 7, the misting device 702 generally comprises water dispensing device or valve 404 that supplies water to the misting jet 706 through tube 704. The misting jet 706 delivers the water to the condenser coil 302 in the form of a spray, sufficient to allow the water to evaporate when it contacts the condenser coil 302. A pan or other water collection device (not shown) positioned underneath or below the condenser coil 302 can be used to collect any excess water that is not evaporated. The timing or cycling of the delivery of the water mist, which in one embodiment is not continuous, can be controlled by parameters such as the ambient heat in the area of the appliance 100 or the relative humidity in the area, as supplied by humidity sensor 212 and temperature sensor 214. For example, the cycle of the timing of the water delivery to the misting device 702 can be controlled by an algorithm that takes into account the relative humidity and/or temperature, as measured by the humidity and temperature sensors 212, 214. If the relative humidity exceeds a pre-determined level, the misting device 702 can be disabled.

The aspects of the disclosed embodiments may also include software and computer programs incorporating the process steps and instructions described above that are executed in one or more computers. In one embodiment, one or more computing devices, such as a computer or controller 216 of FIG. 2, are generally adapted to utilize program storage devices embodying machine-readable program source code, which is adapted to cause the computing devices to perform the method steps of the present disclosure. The program storage devices incorporating features of the present disclosure may be devised, made and used as a component of a machine utilizing optics, magnetic properties and/or electronics to perform the procedures and methods of the present disclosure. In alternate embodiments, the program storage devices may include magnetic media such as a diskette or computer hard drive, which is readable and executable by a computer. In other alternate embodiments, the program storage devices could include optical disks, read-only-memory ("ROM") floppy disks and semiconductor materials and chips.

The computing devices may also include one or more processors or microprocessors for executing stored programs. The computing device may include a data storage device for the storage of information and data. The computer program or software incorporating the processes and method steps incorporating features of the present disclosure may be stored in one or more computers on an otherwise conventional program storage device.

The aspects of the disclosed embodiments are generally directed to an evaporative cooling condenser for a household appliance that utilizes a fluid heat transfer device to bring defrost drain water and/or make-up water in contact with the coils of a condenser in order to remove heat from the condenser and lower the enthalpy of the refrigerant traveling through the condenser into the evaporator. This allows the evaporator to remove more heat from the appliance in an energy efficient and cost effective manner.

Thus, while there have been shown and described and pointed out fundamental novel features of the invention as applied to the exemplary embodiments thereof, it will be understood that various omissions and substitutions and changes in the form and details of devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An evaporative cooling condenser for cooling a condenser of a refrigerant based cooling system disposed in an indoor household appliance, comprising:

a water source;

a fluid heat transfer device configured to receive water from the water source, convert the water into a water vapor, introduce the water vapor into an air flow path through the condenser and enable the condenser to reject heat from the condenser to the water vapor in the air flow path through the condenser; and a humidity sensor configured to detect an indoor ambient humidity level and control a delivery of water from the water source to the fluid heat transfer device based on the detected indoor ambient humidity level.

2. The evaporative cooling condenser of claim 1, wherein the water source comprises at least one of condensation from the exterior of a case of the appliance, defrost drain water from the appliance and make-up water for the appliance.

3. The evaporative cooling condenser of claim 1, wherein the fluid heat transfer device comprises a tube thermally coupled to the condenser, one end of the tube receiving a flow of water from the water source and the other end of the tube releasing a flow of water and vapor into a central portion of the condenser.

4. The evaporative cooling condenser of claim 1, wherein the fluid heat transfer device comprises a water bath receiving water from the water source, the condenser being partially submerged in the water bath.

5. The evaporative cooling condenser of claim 1, wherein the fluid heat transfer device comprises an evaporative pad disposed in a central portion of the condenser, the evaporative pad being configured to absorb water supplied by the water source.

6. The evaporative cooling condenser of claim 1, wherein the air flow path is horizontally disposed through a central portion of the condenser.

7. The evaporative cooling condenser of claim 1, wherein only the water vapor is used to reject heat from the condenser.

8. An indoor household appliance comprising an evaporator stage;

a compressor stage coupled to the evaporator stage;

a heat exchanger stage, the heat exchanger stage being located after the compressor stage and before the evaporator stage, the heat exchanger stage comprising:

a condenser;

a fluid heat transfer device configured to receive water from a water source, convert the water into a water vapor, introduce the water vapor into an air flow path through the condenser and enable the condenser to reject heat from the condenser to the water vapor in the air flow path; and a humidity sensor configured to detect an indoor ambient humidity level and control a delivery of water from the water source to the fluid heat transfer device based on the detected indoor ambient humidity level.

9. The indoor household appliance of claim 8, further comprising a fluid dispensing device configured to supply fluid to the fluid heat transfer device.

10. The indoor household appliance of claim 9, wherein the fluid dispensing device receives water from a defrost water supply and a make-up water supply.

11. The indoor household appliance of claim 8, wherein the fluid heat transfer device comprises a water vapor tube, the water vapor tube being disposed adjacent to and in thermal contact with the condenser and configured to release water vapor into the airflow path through the condenser.

12. The indoor household appliance of claim 11, wherein the water vapor tube comprises a water intake end and a water vapor release end, and a metal tube between the water intake end and the water vapor release end, the metal tube being in thermal contact with the condenser.

13. The indoor household appliance of claim 8, wherein the fluid heat transfer device comprises a water vessel containing water, the water vessel being situated in proximity to the condenser and wherein a surface of the water contained in the water vessel is in the airflow path through, the condenser.

14. The indoor household appliance of claim 13, wherein a portion of the condenser is submerged in the water in the water vessel.

15. The indoor household appliance of claim 8, wherein the fluid heat transfer device comprises an evaporative pad, the evaporative pad being secured within an interior portion of the condenser in the airflow path through the condenser and being configured to absorb water from a water supply to maintain the evaporative pad in a wetted state.

16. The indoor household appliance of claim 15, wherein the evaporative pad is a sponge.

17. The indoor household appliance of claim 15, wherein a portion of the evaporative pad is in contact with the condenser.

18. The indoor household appliance of claim 8, wherein the indoor household appliance is a refrigerator.

* * * * *

UNITED STATES PATENT AND TRADEMARK OFFICE

CERTIFICATE OF CORRECTION

PATENT NO. : 8,534,083 B2
APPLICATION NO. : 12/855361
DATED : September 17, 2013
INVENTOR(S) : Austin et al.

It is certified that error appears in the above-identified patent and that said Letters Patent is hereby corrected as shown below:

In The Specification

In Column 3, Line 7, delete “thy” and insert -- dry --, therefor.

In The Claims

In Column 8, Line 48, in Claim 8, delete “comprising” and insert -- comprising: --, therefor.

In Column 9, Line 18, in Claim 13, delete “through, the condenser.” and insert -- through the condenser. --, therefor.

Signed and Sealed this
Eighth Day of December, 2015

Michelle K. Lee

Michelle K. Lee
*Director of the United States Patent and Trademark Office*